US008410886B2

(12) United States Patent
Odahara et al.

(10) Patent No.: US 8,410,886 B2
(45) Date of Patent: Apr. 2, 2013

(54) MULTILAYER COIL COMPONENT

(75) Inventors: Mitsuru Odahara, Kyoto-fu (JP); Akihiro Motoki, Kyoto-fu (JP); Akihiro Ono, Kyoto-fu (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 13/357,582

(22) Filed: Jan. 24, 2012

(65) Prior Publication Data

US 2012/0119867 A1 May 17, 2012

Related U.S. Application Data

(63) Continuation of application No. PCT/JP2010/058738, filed on May 24, 2010.

(30) Foreign Application Priority Data

Jul. 31, 2009 (JP) ..... 2009-178516

(51) Int. Cl.
*H01F 5/00* (2006.01)

(52) U.S. Cl. ..... 336/200

(58) Field of Classification Search ..... 336/65, 336/83, 200, 232, 206–208
See application file for complete search history.

(56) References Cited

U.S. PATENT DOCUMENTS

| | | | | |
|---|---|---|---|---|
| 4,918,421 | A * | 4/1990 | Lawless et al. | 338/21 |
| 6,404,318 | B1 | 6/2002 | Uchikoba et al. | |
| 6,855,222 | B2 * | 2/2005 | Konoue et al. | 156/89.16 |
| 7,889,044 | B2 * | 2/2011 | Ueda et al. | 336/200 |
| 8,004,383 | B2 * | 8/2011 | Konoue et al. | 336/200 |
| 2008/0123248 | A1 | 5/2008 | Kunishi et al. | |

FOREIGN PATENT DOCUMENTS

| | | | |
|---|---|---|---|
| JP | 04-192403 | A | 7/1992 |
| JP | 2871845 | B2 | 7/1992 |
| JP | 06-333721 | A | 12/1994 |
| JP | 08-083715 | A | 3/1996 |
| JP | 2001-052930 | A | 2/2001 |
| JP | 2002-100508 | A | 4/2002 |
| JP | 2004-022798 | A | 1/2004 |
| JP | 2007-242715 | A | 9/2007 |
| WO | 2007/049456 | A1 | 5/2007 |
| WO | 2009/034824 | A1 | 3/2009 |

OTHER PUBLICATIONS

International Search Report; PCT/JP2010/058738; Aug. 24, 2010.
Written Opinion of the International Searching Authority; PCT/JP2010/058738; Aug. 24, 2010.

* cited by examiner

*Primary Examiner* — Tuyen Nguyen
(74) *Attorney, Agent, or Firm* — Studebaker & Brackett PC; Tim L. Brackett, Jr.; John F. Guay

(57) ABSTRACT

A multilayer coil component is provided to have high reliability and in which internal stress arising from the difference in firing shrinkage behavior and/or thermal expansion coefficient between ferrite layers and internal conductor layers is alleviated without forming conventional voids between the ferrite layers and the internal conductor layers. A method of manufacturing a multilayer coil includes a step of isolating interfaces between internal conductors and surrounding ferrite by allowing a complexing agent solution to reach interfaces between the internal conductors and the surrounding ferrite through side gap portions from side surfaces of a ferrite element including a helical coil. The complexing agent solution contains at least one selected from the group consisting of an aminocarboxylic acid, a salt of the aminocarboxylic acid, an oxycarboxylic acid, a salt of the oxycarboxylic acid, an amine, phosphoric acid, a salt of phosphoric acid, and a lactone compound.

3 Claims, 5 Drawing Sheets

MULTILAYER COIL COMPONENT

The present application is a continuation of International Application No. PCT/JP2010/058738 filed May 24, 2010, which claims priority to Japanese Patent Application No. 2009-178516 filed Jul. 31, 2009, the entire contents of each of these applications being incorporated herein by reference in their entirety.

TECHNICAL FIELD

The present invention relates to a multilayer coil component having a structure in which a helical coil is placed in a ferrite element formed by calcining a ceramic laminate prepared by stacking ferrite layers and internal conductors made of Ag, for forming a coil.

BACKGROUND

In recent years, the downsizing of electronic components has been increasingly demanded. As a result, the mainstream of coil components is shifting to a multilayer type.

Multilayer coil components obtained by co-firing ferrite and internal conductors have a problem that internal stress arising from the difference in thermal expansion coefficient between ferrite layers and internal conductor layers deteriorates magnetic properties of the ferrite layers to cause the reduction or variation in impedance of the multilayer coil components.

To solve such a problem arising from differences in thermal expansion coefficient causing variation in impedance of multilayer coil components, an element has been proposed in which a multilayer impedance element includes voids between ferrite layers and internal conductor layers. The voids are formed by immersing a calcined ferrite element in an acidic plating solution. With the voids present, the influence of stress due to the internal conductor layers on the ferrite layers is thereby avoided. See, Japanese Unexamined Patent Application Publication No. 2004-22798 (Patent Literature 1).

To prevent the inductance from varying due to the influence of a magnetic field, a method has been proposed in which the inductance is stabilized in such a manner that surfaces of internal conductors are corroded by impregnating a multilayer coil component (multilayer chip inductor) with a corrosive solution and voids are formed between a ceramic base and the internal conductors. See, Japanese Unexamined Patent Application Publication No. 4-192403 (Patent Literature 2).

SUMMARY

The present disclosure provides a multilayer coil component having high reliability and low direct-current resistance.

In one aspect of the disclosure, a multilayer coil component comprises a laminate that includes stacked ferrite layers made of ferrite and containing Cu, and a helical coil formed by interlayer-connecting internal conductors made of Ag. The internal conductors are surrounded by the ferrite, the multilayer coil component is formed by calcining the laminate, no voids are present at interfaces between the internal conductors and the surrounding ferrite, the interfaces between the internal conductors and the surrounding ferrite are isolated, and the segregation coefficient of Cu at the interfaces between the internal conductors and the surrounding ferrite is 5% or less.

In another more specific embodiment, the segregation coefficient of Cu at the interfaces between the internal conductors and the surrounding ferrite may be 3% or less.

As used herein, the term "Cu" in "the segregation coefficient of Cu" is a concept including not only metallic copper (Cu) but also copper oxide (CuO). That is, the term "Cu" in "the segregation coefficient of Cu" is a concept meaning Cu or CuO when a precipitate contains either one of Cu and CuO or a concept meaning both Cu and CuO when a precipitate contains both Cu and CuO.

In another more specific embodiment, the multilayer coil component may include side gap portions, which are areas between side portions of the internal conductors and side surfaces of the ferrite element, and a pore area fraction of ferrite contained in the side gap portions of the ferrite element may be within the range of 6% to 20%.

In another aspect of the disclosure, a method for manufacturing a multilayer coil component includes a step of forming a ferrite element including a helical coil disposed therein by calcining a laminate including a plurality of ferrite green sheets made of ferrite and containing Cu, and a plurality of internal conductor patterns made of Ag, for forming the coil. The internal conductor patterns are stacked with the ferrite green sheets disposed therebetween. The method includes a step of isolating interfaces between internal conductors and surrounding ferrite by allowing a complexing agent solution to reach the interfaces between the internal conductors and the surrounding ferrite through side gap portions, which are areas between side portions of the internal conductors and side surfaces of the ferrite element, from the side surfaces of the ferrite element. The complexing agent solution is a solution containing at least one selected from the group consisting of an aminocarboxylic acid, a salt of the aminocarboxylic acid, an oxycarboxylic acid, a salt of the oxycarboxylic acid, an amine, phosphoric acid, a salt of phosphoric acid, and a lactone compound.

In a more specific embodiment, in the multilayer coil component manufacturing method the aminocarboxylic acid may be at least one selected from the group consisting of glycin, glutamic acid, and aspartic acid; the aminocarboxylic acid salt may be at least one selected from the group consisting of a salt of glycin, a salt of glutamic acid, and a salt of aspartic acid; the oxycarboxylic acid may be at least one selected from the group consisting of citric acid, tartaric acid, gluconic acid, glucoheptonic acid, and glycolic acid; the oxycarboxylic acid salt may be at least one selected from the group consisting of a salt of citric acid, a salt of tartaric acid, a salt of gluconic acid, a salt of glucoheptonic acid, and a salt of glycolic acid; the amine may be at least one selected from the group consisting of triethanolamine, ethylenediamine, and ethylenediaminetetraacetic acid; phosphoric acid used may be pyrophosphoric acid; the phosphoric acid salt may be a salt of pyrophosphoric acid; and the lactone compound may be at least one selected from the group consisting of gluconolactone and glucoheptonolactone.

In yet another more specific embodiment, in the multilayer coil component manufacturing method, in the step of forming the ferrite element, the ferrite element may be formed such that a pore area fraction of ferrite contained in the side gap portions is within the range of 6% to 20%.

DETAILED DESCRIPTION

The inventors realized that in the multilayer impedance element described in Patent Literature 1, the ferrite element is immersed in the plating solution such that the plating solution permeates the ferrite element through portions of the internal conductor layers that are exposed at surfaces of the ferrite element and discontinuous voids are thereby formed between the ferrite layers and the internal conductor layers. Therefore, the internal conductor layers and the voids are present between the ferrite layers and the internal conductor layers have a reduced thickness. Thus, a reduction in percentage of the internal conductor layers between the ferrite layers is inevitable.

Therefore, there is a problem in that it is difficult to obtain products with low direct-current resistance. In particular, small-sized products such as products with a size of 1.0 mm×0.5 mm×0.5 mm and products with a size of 0.6 mm×0.3 mm×0.3 mm need to include thin ferrite layers; hence, it is difficult that both internal conductor layers and voids are provided between the ferrite layers and the internal conductor layers are formed so as to be thick. Therefore, there is a problem in that the direct-current resistance cannot be reduced or sufficient reliability cannot be achieved and the internal conductor layers are likely to be broken by surging.

The inventors also realized that in the method described in Patent Literature 2, the corrosive solution used is a highly corrosive solution such as an aqueous solution containing a halide, hydrohalic acid, sulfuric acid, oxalic acid, or nitric acid, and therefore the solution can corrode not only interfaces between internal electrodes and other portions, but also interfaces between external electrodes and other portions. This leads to a problem that the adhesion of the external electrodes is reduced and/or the external electrodes can peel off.

In the multilayer coil component disclosed herein, problems associated with internal stress arising from the difference in firing shrinkage behavior or thermal expansion coefficient between ferrite layers and internal conductor layers included in the multilayer coil component can be alleviated without forming conventional voids between the ferrite layers and the internal conductor layers and internal conductors are unlikely to be broken by surging or the like.

The inventors have made various investigations to solve the above problems and have found that the segregation coefficient of Cu at the interface between an internal conductor and ferrite correlates with the bonding strength between the internal conductor and surrounding ferrite. The inventors have further performed experiments and investigations to complete the present disclosure.

Features consistent with the present disclosure that can address the above problems are now described in detail with reference to examples.

Example 1

Figure 1:
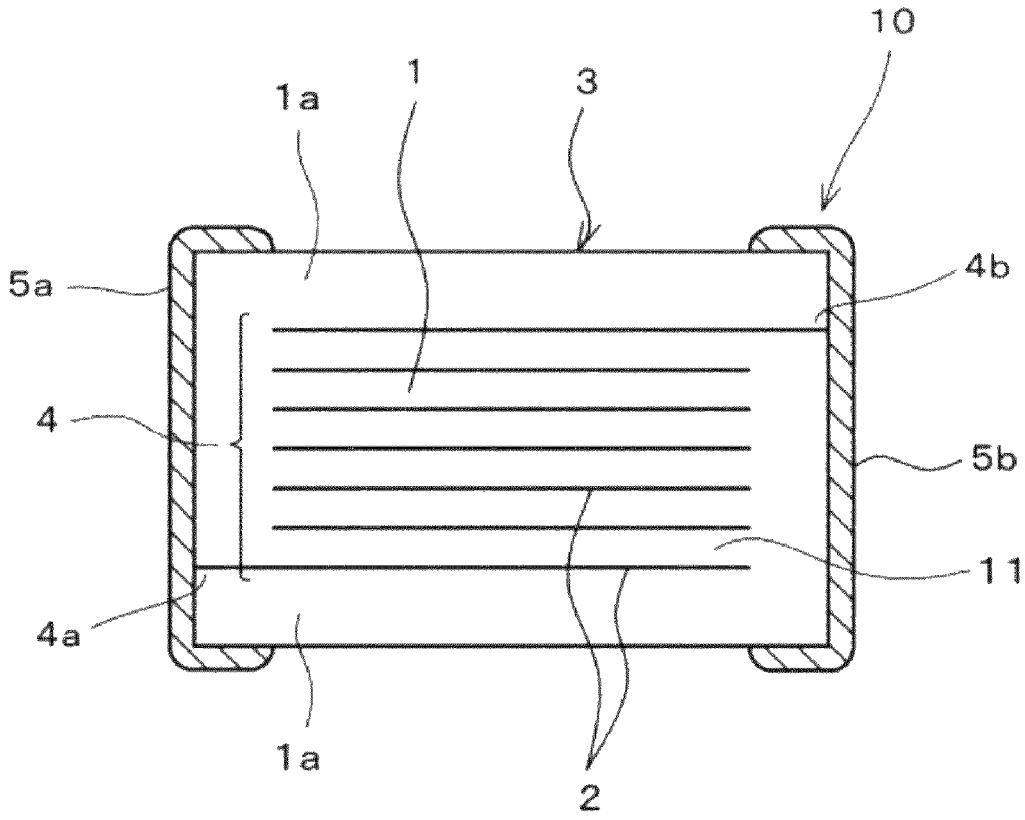
FIG. 1 is a front sectional view illustrating the configuration of a multilayer coil component according to an example 1 of the present disclosure.
Figure 2:
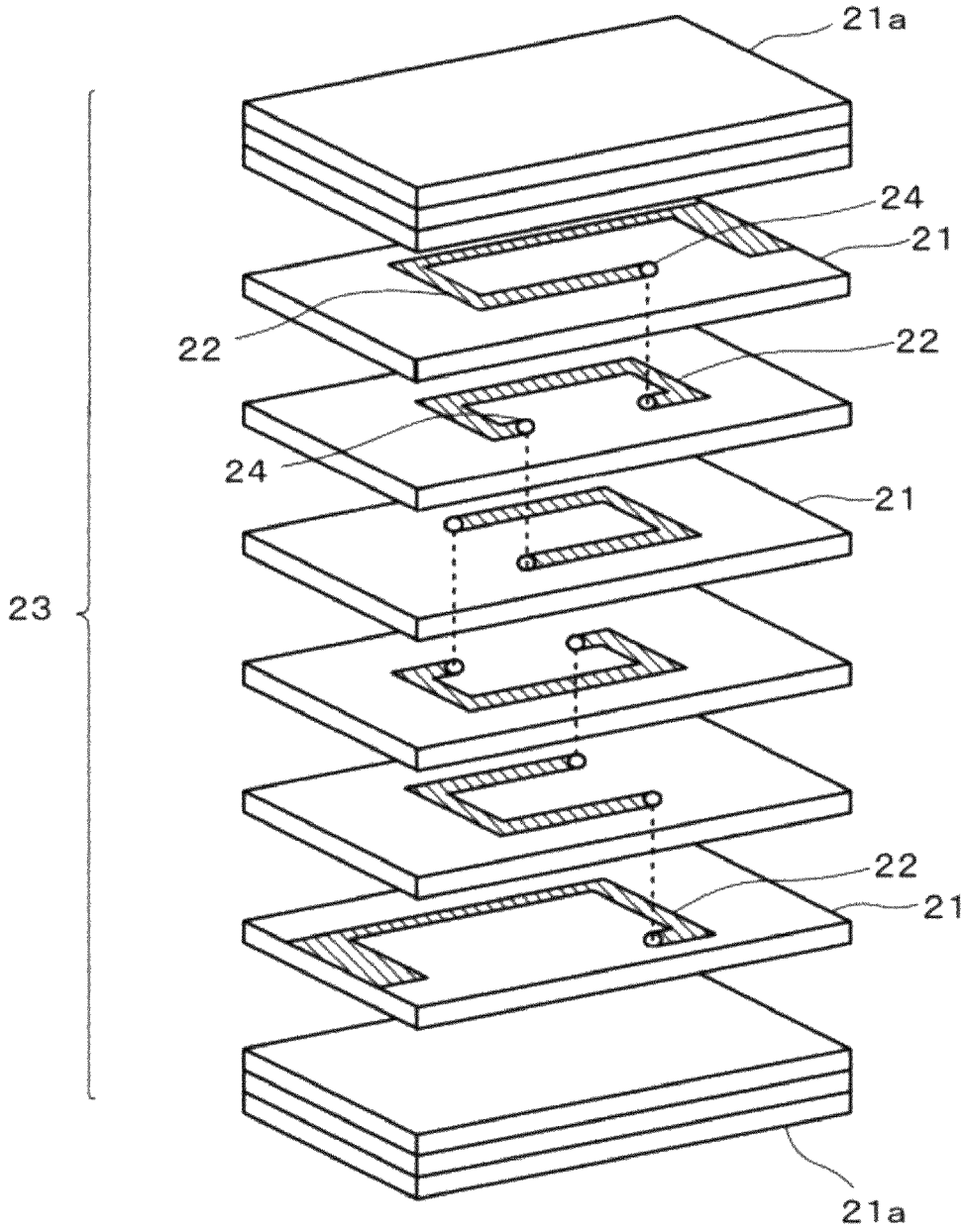
FIG. 2 is an exploded perspective view illustrating a method for manufacturing the multilayer coil component according to the example shown in FIG. 1.
Figure 3:
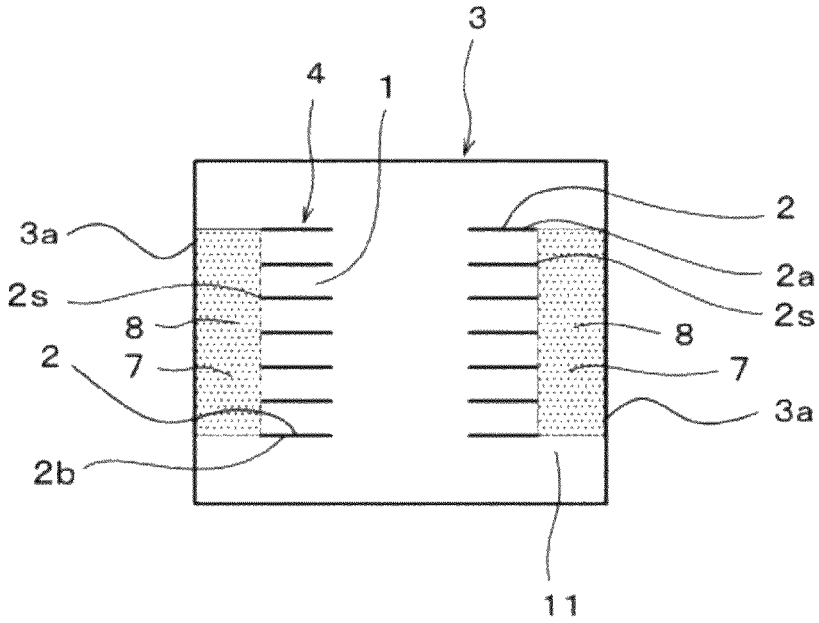
FIG. 3 is a side sectional view illustrating the configuration of the multilayer coil component according to the example shown in FIG. 1.

FIG. 1 is a front sectional view illustrating the configuration of a multilayer coil component (in Example 1, a multilayer impedance element) according to a first example. FIG. 2 is an exploded perspective view illustrating a method for manufacturing the multilayer coil component. FIG. 3 is a side sectional view illustrating the configuration of the multilayer coil component shown in FIG. 1.

As shown in FIGS. 1 to 3, the multilayer coil component 10 is manufactured through a step of calcining a laminate including stacked ferrite layers 1 and internal conductors 2, made of Ag, for forming a coil and includes a helical coil 4 disposed in a ferrite element 3. The ferrite layers 1 and conductors 2 are provided between outer ferrite layers 1*a* and 1*b*.

A pair of external electrodes 5*a* and 5*b* are arranged on both end portions of the ferrite element 3 so as to be electrically connected to both end portions 4*a* and 4*b* of the helical coil 4.

In the multilayer coil component 10, no voids are present at interfaces between the internal conductors 2 and surrounding ferrite 11. While the internal conductors 2 and the ferrite 11 are substantially in intimate contact with each other, the internal conductors 2 and the ferrite 11 are arranged to be isolated with the interfaces therebetween.

With reference to FIG. 3, the ferrite element 3 includes a central region 7 located between the uppermost internal conductor 2*a* and the lowermost internal conductor 2*b*. The central region 7 includes side gap portions 8 that are areas between side portions 2*s* of the internal conductors 2 and side surfaces 3*a* of the ferrite element 3. The side gap portions 8 are made of porous ferrite with a pore area fraction of 6% to 20% (in the multilayer coil component of Example 1, 14%).

While no voids are present at the interfaces between the internal conductors 2 and the ferrite 11, and the internal conductors 2 and the ferrite 11 are substantially in intimate contact with each other, the internal conductors 2 and the ferrite 11 are arranged to be isolated with the interfaces therebetween.

The multilayer coil component 10 of this example has a length L of 0.6 mm, a thickness T of 0.3 mm, and a width W of 0.3 mm, although these dimensions are exemplary and other examples can have larger or smaller dimensions.

In the multilayer coil component 10, the segregation coefficient of Cu at the interfaces between the internal conductors 2 and the ferrite 11 is 5% or less. Therefore, the interfaces between the internal conductors and the ferrite can be sufficiently isolated and the stress applied to the ferrite can be relieved without allowing any voids to be present at the interfaces between the internal conductors 2 and the ferrite 11.

Since the interfaces between the internal conductors 2 and the ferrite 11 are isolated in such a state that no voids are present at the interfaces between the internal conductors 2 and the ferrite 11, the multilayer coil component 10 can be obtained such that the stress applied to the ferrite surrounding the internal conductors is relieved without thinning the internal conductors. That is, the following component can be obtained: a high-reliability multilayer coil component in which variations in properties are small, the direct-current resistance can be reduced, and internal conductor layers are unlikely to be broken by surging.

An exemplary method for manufacturing the multilayer coil component 10 will now be described.

(1) Magnetic raw materials were prepared by weighing $Fe_2O_3$, ZnO, NiO, and CuO at a ratio of 48.0:29.5:14.5:8.0 on a mole percent basis and were then wet-mixed for 48 hours in a ball mill. Slurry prepared by wet mixing was dried in a spray dryer and was then calcined at 700° C. for two hours. A calcined powder thereby obtained was preliminarily pulverized, whereby a ceramic (ferrite) source material used in subsequent Step (2) was prepared.

(2) The ceramic source material, which was prepared in Step (1), pure water, and a dispersant were wet-mixed and were then wet-pulverized for 16 hours using a ball mill. After this solution was wet-mixed with a binder, a plasticizer, a humectant, an antifoam, and the like for eight hours in a ball mill, the mixture was vacuum-defoamed, whereby a ceramic (ferrite) slurry used in subsequent Step (3) was prepared.

(3) The ceramic slurry, which was prepared in Step (2), was formed into sheets, whereby ceramic (ferrite) green sheets with a thickness of 12 μm were prepared.

(4) After via-holes were drilled in predetermined locations in the ferrite green sheets, a conductive paste for forming an internal conductor was applied to surfaces of some of the ferrite green sheets, whereby coil patterns (internal conductor patterns) with a thickness of 16 μm were formed.

The conductive paste used was one prepared by blending an Ag powder with an impurity content of 0.1% by weight or less, varnish, and a solvent and had an Ag content of 85% by weight.

(5) As schematically shown in FIG. 2, some of the ferrite green sheets 21 having the internal conductor patterns (coil patterns) 22 were stacked and were then pressed. The ferrite green sheets 21*a*, having no coil pattern, for outer regions were stacked on the upper and lower surfaces of the stack and were then pressed at 1,000 kgf/cm$^2$, whereby a laminate (uncalcined ferrite element) 23 was obtained. A method for stacking the ferrite green sheets is not particularly limited.

The uncalcined ferrite element 23 includes a layered helical coil formed by connecting the internal conductor patterns (coil patterns) 22 to each other with the via-holes 24. The number of turns of the coil was 19.5.

(6) The laminate 23 was cut so as to have a predetermined size, was degreased, and was then sintered at 870° C., whereby a ferrite element including the helical coil disposed therein was obtained.

(7) A conductive paste for forming an external electrode was applied to both end portions of the ferrite element (sintered element) 3 including the helical coil 4 by a dipping process, was dried, and was then baked at 750° C., whereby the external electrodes 5*a* and 5*b* (see FIG. 1) were formed.

The conductive paste for forming an external electrode was one prepared by blending an Ag powder with an average particle size of 0.8 μm, a B—Si—K glass frit with an average particle size of 1.5 μm, varnish, and a solvent. The external electrodes formed by baking this conductive paste were dense and were unlikely to be corroded by a plating solution in a plating step below.

(8) A solution of a complexing agent used was a 0.2 mol/L aqueous solution of citric acid monohydrate (produced by Nacalai Tesque, Inc.). The ferrite element was immersed in this solution for three, six, 12, and 24 hours, whereby stress relief treatment for isolating interfaces between the internal electrodes and surrounding ferrite was performed. The ferrite element was ultrasonically cleaned for 15 minutes in water.

In this example, the complexing agent solution used was the 0.2 mol/L aqueous solution of citric acid monohydrate. The concentration thereof is not limited to this value and can be adjusted to an appropriate value in consideration of various conditions. Besides such an aqueous solution, a solution prepared by dissolving the complexing agent in a solvent other than water can be used.

(9) The formed external electrodes 5*a* and 5*b* were plated with Ni and Sn by a barrel plating process, whereby two-layer structure plating films including Ni plating layers and Sn plating layers located thereon were formed on the external electrodes 5*a* and 5*b*. This allows for obtaining the multilayer coil component (multilayer impedance element) 10 having such a structure as shown in FIG. 1. The multilayer impedance element 10 has a target impedance (|Z|) of 1,000Ω at 100 MHz.

In a comparative example, comparative samples (multilayer impedance elements) identical in structure to one manufactured in the example were prepared by substantially the same procedure under the same conditions as those of Steps (1) to (9) except that stress relief treatment for isolating interfaces between internal electrodes and surrounding ferrite was performed in Step (8) in such a manner that elements were immersed in a 0.2 mol/L aqueous solution of hydrochloric acid (produced by Nacalai Tesque, Inc.) instead of citric acid monohydrate for three, six, 12, or 24 hours.

For the multilayer impedance elements (samples) manufactured through the step of immersing each element in the complexing agent (or hydrochloric acid) solution for three, six, 12, or 24 hours in the example or comparative example, the segregation coefficient of Cu at the interfaces between the internal conductors and the surrounding ferrite was measured and the impedance UZI at 100 MHz) was also measured. The relationship between the value of |Z| and the segregation coefficient of Cu at the interfaces between the internal conductors 2 and the surrounding ferrite 11 was investigated. Furthermore, for the samples, the flexural strength was measured and the pore area fraction of each side gap portion was measured.

The segregation coefficient of Cu, |Z| (at 100 MHz), the flexural strength, and the pore area fraction of the side gap portion were measured by methods described below.

[A] Measurement of Segregation Coefficient of Cu:

(1) Each chip is cut with nippers, whereby internal electrode/ferrite interfaces are separated.

(2) Next, Cu on ferrite is subjected to mapping analysis using a WDX (wavelength-dispersive X-ray microanalyzer).

Apparatus: JOEL JXA8800R

Analysis condition: an acceleration voltage of 15 kV

Irradiation current: 100 nA

Pixel number (the number of pixels): 256×256

Pixel size (the size of one pixel): 0.64 μm

Dwell time (the dwell time per pixel): 50 ms

Region analyzed in depth direction: about 1 to 2 μm (3) Calculation of Cu Segregation Coefficient:

When the number of counts for measurement points is not less than (the average number of counts for all the measurement points+1σ), the measurement points are determined to be Cu segregation.

For an arbitrary measurement region, the Cu segregation coefficient is defined as a value obtained by dividing the Cu segregation number divided by the number of all measurement points in the measurement region and multiplying the quotient by 100.

A mapping image of Cu shown in FIG. 4 and mapping analysis results shown in Table 1 are as described below.

TABLE 1

| | Number of measurement points | | Cu segregation number | Cu segregation coefficient |
|---|---|---|---|---|
| All regions | 256 × 256 | 65536 | 4720 | 7.2% |
| Region (1) (Internal conductor contact portion) | 65 × 65 | 4225 | 72 | 1.7% |
| Region (2) (Internal conductor non-contact portion inside coil) | 65 × 65 | 4225 | 367 | 8.7% |

Figure 4:
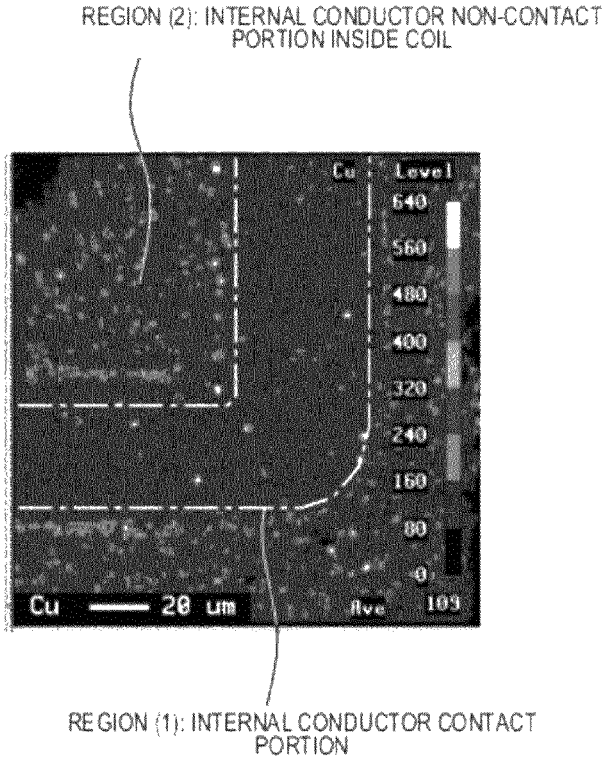
FIG. 4 is an illustration of a mapping image of Cu observed with a WDX for the purpose of describing a method for measuring the segregation coefficient of Cu.

When the number of measurement points in all regions shown in FIG. 4 is 65,536, the Cu segregation number is 4,720 and therefore the Cu segregation coefficient is calculated as follows: (4,720/65,536)×100=7.2%.

When the number of measurement points in Region (1) (an internal conductor contact portion) shown in FIG. 4 is 4,225, the Cu segregation number is 72 and therefore the Cu segregation coefficient is calculated as follows: (72/4,225)×100=1.7%.

When the number of measurement points in Region (2) (an internal conductor non-contact portion inside a coil) shown in FIG. 4 is 4,225, the Cu segregation number is 367 and therefore the Cu segregation coefficient is calculated as follows: (367/4,225)×100=8.7%.

[B] Measurement of Impedance |Z|:

Fifty of the samples were measured for impedance using an impedance analyzer (HP 4291A, manufactured by Hewlett-Packard Company) and the average (n=50 pcs) was determined.

[C] Measurement of Flexural Strength:

Fifty of the samples were measured by a test method specified in EIAJ-ET-7403 and the strength at a fracture probability of 1% in a Weibull plot was defined as the flexural strength (n=50 pcs).

[D] Measurement of Pore Area Fraction:

The side gap portions 8 between the side portions 2*s* of the internal conductors 2 and the side surfaces 3*a* of the ferrite element 3 shown in FIG. 3 were measured for pore area fraction by a method below.

In particular, the pore area fraction was measured with an image-processing software program, "WINROOF (Mitani Corporation)." A detail measurement method is as described below:

FIB system: FEI FIB200TEM

FE-SEM (scanning electron microscope): JOEL JSM-7500FA

Figure 5:
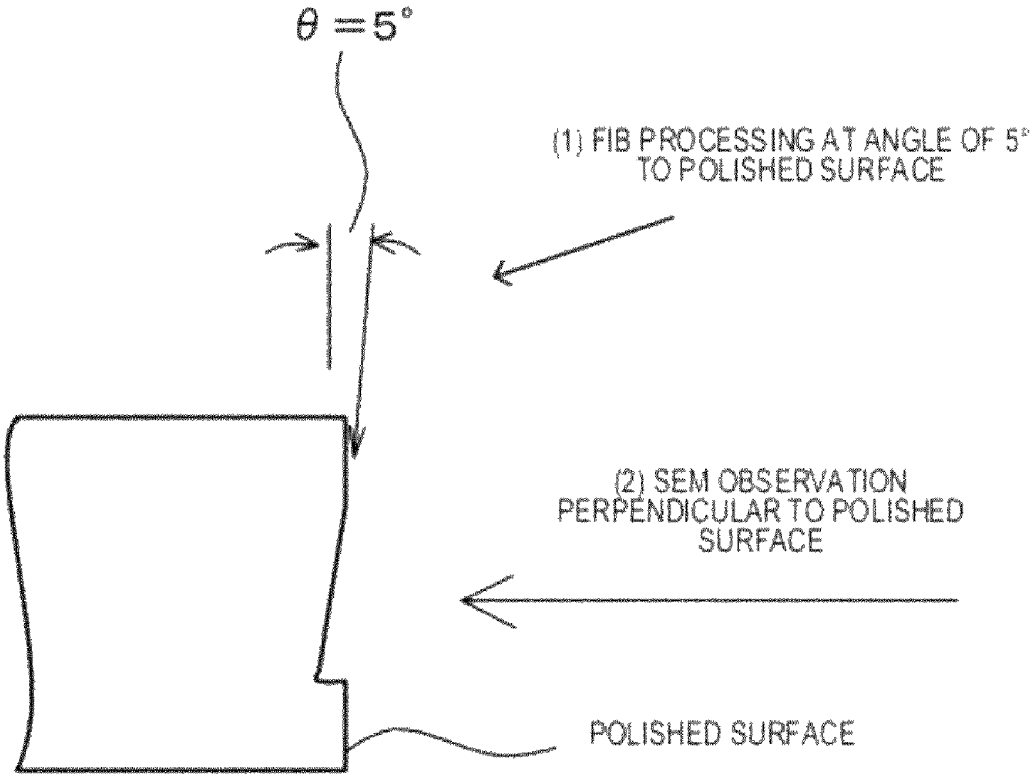
FIG. 5 is an illustration of a method for measuring the pore area fraction of the multilayer coil component according to the example shown in FIG. 1 and that of a comparative example.

WINROOF (image-processing software program): Ver. 5.6, developed by Mitani Corporation Focused Ion Beam Milling (FIB Milling):

As shown in FIG. 5, the polished surface of the sample that was mirror-polished by the above-mentioned method was subjected to FIB milling at an incident angle θ of 5°.

Observation with scanning electron microscope (SEM):

SEM observation was performed under conditions below:

Acceleration voltage: 15 kV

Sample inclination: 0°

Signal: secondary electron

Coating: Pt

Magnification: 5,000×

Calculation of Pore Area Fraction:

The pore area fraction was determined by the following method:

(a) Determine a measurement region. An error will arise if the measurement region is too small. (In this example, the size thereof was 22.85 μm×9.44 μm.)

(b) When it is difficult to distinguish the pores from the magnetic ceramic, adjust the brightness and/or the contrast.

(c) Extract the pores only by binarization. When "Color Extraction" of the image-processing software program WINROOF is insufficient, perform manual compensation.

(d) If those other than the pores are extracted, eliminate those other than the pores.

(e) Determine the total area, number, and area fraction of the pores and the area of the measurement region using "total area/number measurement" of the image-processing software program.

The pore area fraction used in the present disclosure is a value determined as described above.

TABLE 2

| | Example 1 | | | | Comparative Example | | | |
|---|---|---|---|---|---|---|---|---|
| | Solution | | | | | | | |
| | Citric acid monohydrate | | | | Hydrochloric acid | | | |
| Treatment time (hours) | 3 | 6 | 12 | 24 | 3 | 6 | 12 | 24 |
| \|Z\| at 100 MHz (Ω) | 1020 | 1050 | 1049 | 1052 | 1048 | 1055 | Unmeasurable | Unmeasurable |
| Flexural strength (N) | 19 | 19 | 19 | 18 | 11 | 10 | 8 | 6 |
| Cu segregation coefficient (%) (Internal conductor contact portion) | 4.9 | 3.0 | 1.7 | 1.6 | Unanalyzable | Unanalyzable | Unanalyzable | Unanalyzable |
| Pore area fraction of side gap portion (%) | 14 | 14 | 14 | 14 | 14 | 14 | 14 | 14 |

A cross section (hereinafter referred to as "W-T surface") of each multilayer impedance element (sample) that was defined by a width direction and thickness direction thereof was mirror-polished, was subjected to focused ion beam milling (FIB milling), and was then observed with a scanning electron microscope (SEM), whereby the area fraction of pores in a magnetic ceramic was measured.

As shown in Table 2, for the multilayer impedance element manufactured by the method of Example 1, 1,000Ω (at 100 MHz), which is target |Z|, can be achieved when the immersion time in the complexing agent solution (the 0.2 mol/L aqueous solution of citric acid monohydrate) is three hours or more. The Cu segregation coefficient is 5% or less when the immersion time is three hours or more.

These results show that a sufficient stress relief effect is achieved when the Cu segregation coefficient is 5% or less.

Figure 6A:
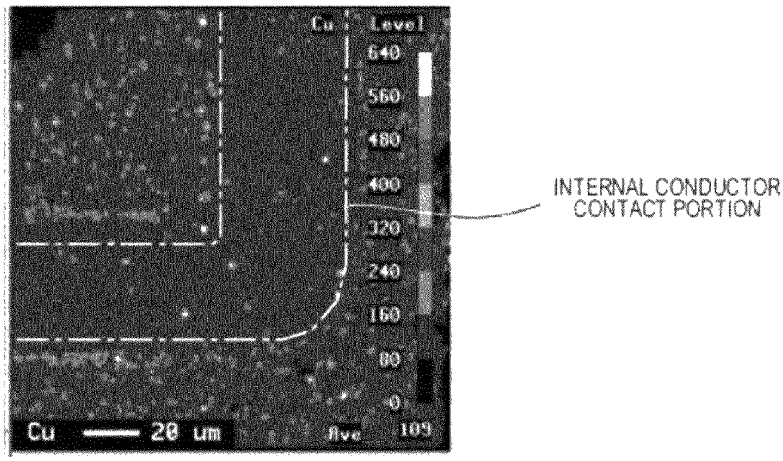
FIG. 6A is an illustration of a mapping image of Cu observed with a WDX in the case where the immersion time of a sample in a complexing agent solution is 12 hours.

FIG. 6A is a mapping image of Cu observed with the WDX in the case where the immersion time is 12 hours. From the mapping image, the Cu segregation coefficient is determined to be 1.7%.

Figure 6B:
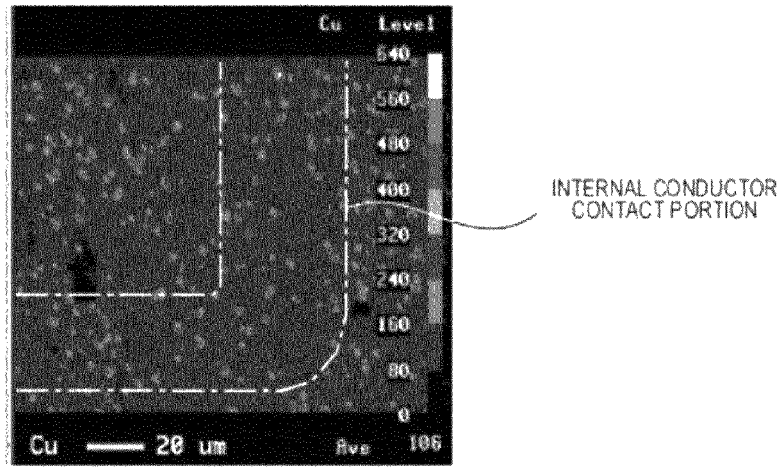
FIG. 6B is an illustration of a mapping image of Cu observed with the WDX before the sample is immersed in the complexing agent solution (before stress relief treatment is performed).

FIG. 6B is an illustration of a mapping image of Cu observed with the WDX before the sample is immersed in the complexing agent solution (the 0.2 mol/L aqueous solution of citric acid monohydrate) (that is, before stress relief treatment is performed). As is clear from this mapping image, the Cu segregation coefficient is high, greater than 5%, before stress relief treatment is performed.

This result is due to efficiently performed stress relief treatment because the pore area fraction of the side gap portions of the multilayer impedance element manufactured in Example 1 is large, 14%, as shown in Table 2, and therefore the complexing agent solution securely reaches interfaces between the internal conductors and surrounding ferrite through the side gap portions.

In the comparative example, the multilayer impedance elements immersed in the 0.2 mol/L aqueous solution of hydrochloric acid for 12 hours or more were not capable of being measured for |Z| because external electrodes thereof were peeled off after ultrasonic cleaning. The multilayer impedance elements (samples) immersed therein for three or six hours were not capable of being measured for Cu segregation coefficient because the samples were broken into pieces when the samples were cut with nippers. This confirms that the use of the 0.2 mol/L aqueous solution of hydrochloric acid causes a serious reduction in strength.

Example 2

Multilayer impedance elements (samples) were manufactured by substantially the same method as that described in Example 1 except that a 0.2 mol/L aqueous solution of gluconolactone (produced by Nacalai Tesque, Inc.) was used instead of the complexing agent solution (i.e., the 0.2 mol/L aqueous solution of citric acid monohydrate) used in the stress-relieving step (8) described in Example 1 and stress relief treatment was performed in such a manner that the multilayer impedance elements (samples) were immersed in the 0.2 mol/L aqueous solution of gluconolactone for three, six, 12, or 24 hours.

In this example, the 0.2 mol/L aqueous solution of gluconolactone was used as a complexing agent solution. The concentration thereof is not limited to this value and can be adjusted to an appropriate value in consideration of various conditions. Besides such an aqueous solution, a solution containing a solvent other than water can be used.

For the multilayer impedance elements, the Cu segregation coefficient, the impedance UZI at 100 MHz), the flexural strength, and the pore area fraction of side gap portions were measured by the same methods as those described in Example 1.

The results are shown in Table 3.

TABLE 3

| | Example 2 Solution Gluconolactone solution | | | |
|---|---|---|---|---|
| Treatment time (hours) | 3 | 6 | 12 | 24 |
| \|Z\| at 100 MHz (Ω) | 760 | 1010 | 1046 | 1055 |
| Flexural strength (N) | 19 | 19 | 19 | 19 |
| Cu segregation coefficient (%) (Internal conductor contact portion) | 7.9 | 5.0 | 1.8 | 1.5 |
| Pore area fraction of side gap portion (%) | 14 | 14 | 14 | 14 |

As shown in Table 3, in the case of using the 0.2 mol/L aqueous solution of gluconolactone as a complexing agent solution, 1,000Ω. (at 100 MHz), which is target |Z|, can be achieved when the immersion time in the complexing agent solution is six hours or more. The Cu segregation coefficient is 5% or less when the immersion time is six hours or more.

These results show that a sufficient stress relief effect is achieved when the Cu segregation coefficient is 5% or less, and more preferably, 3% or less.

The time taken for stress relief in Example 2 is longer than that described in Example 1. This is probably because the use of the 0.2 mol/L aqueous solution of gluconolactone as a complexing agent solution reduces the elution of copper more significantly than the use of the 0.2 mol/L aqueous solution of citric acid monohydrate in Example 1.

Example 3

Multilayer impedance elements (samples) including side gap portions having a pore area fraction of 3% to 26% were manufactured in such a manner that the calcination temperature of Step (6) described in Example 1 was varied within the range of 840° C. to 900° C. for the purpose of investigating the influence of the pore area fraction of the side gap portions on a stress relief effect. Stress relief treatment was performed using a 0.2 mol/L aqueous solution of citric acid monohydrate as a complexing agent solution. For the rest, substantially the same method and conditions as those described in Example 1 were used.

For the multilayer impedance elements, the Cu segregation coefficient, the impedance UZI at 100 MHz), the flexural strength, and the pore area fraction of side the gap portions were measured by the same methods as those described in Example 1.

The results are shown in Table 4.

TABLE 4

| | Calcination temperature (° C.) | | | | |
|---|---|---|---|---|---|
| | 840 | 855 | 870 | 885 | 900 |
| Pore area fraction of side gap portion (%) | 26 | 20 | 14 | 6 | 3 |
| \|Z\| at 100 MHz (Ω) | 930 | 1015 | 1049 | 1048 | 570 |
| Flexural strength (N) | 13 | 18 | 19 | 20 | 21 |
| Cu segregation coefficient (%) (Internal conductor contact portion) | Unanalyzable | 1.5 | 1.7 | 1.8 | Unanalyzable |

As shown in Table 4, in the case of the samples sintered at 855° C. to 885° C., the side gap portions have a pore area fraction of 6% to 20%, the Cu segregation coefficient is 5% or less (1.5% to 1.8%), and 1,000Ω (at 100 MHz), which is target |Z|, can be achieved.

However, the sample sintered at 840° C. was not capable of being analyzed for Cu segregation coefficient because this sample had a large pore area fraction of 26% and significantly low strength and therefore was broken into pieces when being cut with nippers. Furthermore, |Z| was 930Ω, which is less than the target 1,000Ω (at 100 MHz).

For the sample sintered at 900° C., since the pore area fraction of the side gap portions is low (3%), the complexing agent solution (the 0.2 mol/L aqueous solution of citric acid monohydrate) was not capable of sufficiently permeating this sample and therefore stress relief was not capable of being satisfactorily performed. Therefore, |Z| was 570Ω, which is significantly less than the target 1,000Ω (at 100 MHz).

Peeling did not occur at interfaces between internal electrodes and ferrite when this sample was cut with nippers; hence, the Cu segregation coefficient thereof was not capable of being measured.

The above examples have been described using a so-called sheet-stacking method including a step of stacking ferrite green sheets as an example. A multilayer coil component according to the present disclosure can be manufactured by a so-called sequential printing method in which a ferrite slurry and a conductive paste for forming an internal electrode are prepared and are printed such that a laminate having such a configuration as described in each example is formed.

Alternatively, the multilayer coil component can be manufactured by, for example, a so-called sequential transfer method in which a ceramic layer formed by printing (applying) a ceramic slurry on a carrier film is transferred onto a table, an electrode paste layer formed by printing (applying) an electrode paste on a carrier film is transferred thereonto, and a laminate having such a configuration as described in each example is formed by repeating this procedure.

In each of the above examples, the case of manufacturing a single multilayer impedance element (single product manufacturing) has been described. For large-scale manufacture, the following method can be used: a so-called multi-product manufacturing method in which a large number of multilayer impedance elements are simultaneously manufactured through the steps of printing, for example, a large number of coil conductor patterns on a surface each mother ferrite green sheet; forming an uncalcined laminate block by stacking and pressing the mother ferrite green sheets; and cutting the laminate block into laminates for individual multilayer impedance elements in accordance with the arrangement of the coil conductor patterns.

A multilayer coil component according to the present disclosure can be manufactured by another method, which is not particularly limited.

In each of the above examples, the multilayer coil component has been described using a multilayer impedance element as an example. The present disclosure is applicable to various multilayer coil components such as multilayer inductors and multilayer transformers.

In a multilayer coil component according to embodiments of the present disclosure, the segregation coefficient of Cu at interfaces between internal conductors and surrounding ferrite is 5% or less; hence, the interfaces between the internal conductors and the surrounding ferrite can be sufficiently isolated without allowing any voids to be present at interfaces between the internal conductors and the surrounding ferrite. As a result, the following component can be provided: a multilayer coil component in which stress is inhibited or prevented from being applied to the ferrite surrounding the internal conductors, variations in properties are small, and the internal conductors can be inhibited or prevented from being broken by surging and which has high impedance, low resistance, and high reliability.

When the segregation coefficient of Cu at the interfaces between the internal conductors and the surrounding ferrite is 3% or less, the interfaces between the internal conductors and the surrounding ferrite can be securely isolated. This allows the embodiments consistent with the present disclosure to be more effective.

In the multilayer coil component according to the present disclosure, a pore area fraction of ferrite contained in the side gap portions, which are the areas between the side portions of the internal conductors and the side surfaces of the ferrite element, can be within the range of 6% to 20%. Therefore, a complexing agent solution can be allowed to securely and effectively reach the interfaces between the internal conductors and the surrounding ferrite through the side gap portions.

The pore area fraction of the side gap portions can be effectively adjusted to 6% to 20% by considering a combination of ferrite green sheets and a conductive paste for forming an internal conductor, the ferrite green sheets and the conductive paste being used in steps of manufacturing common multilayer coil components.

In a method for manufacturing the multilayer coil component according to the present disclosure, the complexing agent solution can be made to reach the interfaces between the internal conductors and the surrounding ferrite through the side gap portions, which are the areas between the side portions of the internal conductors and the side surfaces of the ferrite element, from the side surfaces of the ferrite element, whereby the interfaces between the internal conductors and the surrounding ferrite are isolated. The complexing agent solution can be a solution containing at least one selected from the group consisting of an aminocarboxylic acid, a salt of the aminocarboxylic acid, an oxycarboxylic acid, a salt of the oxycarboxylic acid, an amine, phosphoric acid, a salt of phosphoric acid, and a lactone compound. Therefore, the segregation coefficient of Cu can be adjusted to 5% or less (more preferably 3% or less) by dissolving off Cu at the interfaces between the internal conductors and the surrounding ferrite and the internal conductors and the surrounding ferrite can be isolated.

The complexing agent solution used herein is less corrosive to ferrite and electrodes than acidic solutions used in conventional processes. Therefore, a multilayer coil component with good properties can be obtained.

According to the present disclosure, unlike conventional multilayer coil components having voids for disrupting the binding between internal conductors and a surrounding magnetic ceramic, a stress-relieved state can be achieved without thinning internal conductors.

Thus, the following component can be manufactured: a multilayer coil component which has low resistance, good properties such as inductance and impedance, and high reliability and in which the occupancy of internal conductors is high and the internal conductors are unlikely to be broken by surging.

The aminocarboxylic acid can be at least one selected from the group consisting of glycin, glutamic acid, and aspartic acid. The aminocarboxylic acid salt can be at least one selected from the group consisting of a salt of glycin, a salt of glutamic acid, and a salt of aspartic acid. The oxycarboxylic acid can be at least one selected from the group consisting of citric acid, tartaric acid, gluconic acid, glucoheptonic acid, and glycolic acid. The oxycarboxylic acid salt can be at least one selected from the group consisting of a salt of citric acid, a salt of tartaric acid, a salt of gluconic acid, a salt of glucoheptonic acid, and a salt of glycolic acid. The amine can be at least one selected from the group consisting of triethanolamine, ethylenediamine, and ethylenediaminetetraacetic acid. Phosphoric acid used can be pyrophosphoric acid. The phosphoric acid salt can be a salt of pyrophosphoric acid. The lactone compound can be at least one selected from the group consisting of gluconolactone and glucoheptonolactone. Therefore, the internal conductors and the surrounding ferrite can be more securely isolated.

In a step of forming the ferrite element, a pore area fraction of ferrite contained in the side gap portions can be adjusted to be within the range of 6% to 20%, whereby the complexing agent solution is allowed to securely reach the interfaces between the internal conductors and ferrite through the side gap portions. This can allow the embodiments of the present disclosure to be more effective.

The present disclosure is not limited to the above examples. Within the scope of the present disclosure, various modifications and variations can be made to the type of a complexing agent used in a complexing agent solution, the concentration of the complexing agent in the complexing agent solution, the type of a solvent used to dissolve the complexing agent, the thickness of an internal conductor, the thickness of a ferrite layer, the size of a product, and conditions for calcining a laminate (ferrite element).

That which is claimed is:

1. A multilayer coil component comprising:

a laminate including:

stacked ferrite layers made of ferrite and containing Cu; and a helical coil formed by interlayer-connecting internal conductors made of Ag, wherein the internal conductors are surrounded by the ferrite, the multilayer coil component is formed by calcining the laminate, no voids are present at interfaces between the internal conductors and the surrounding ferrite, the interfaces between the internal conductors and the surrounding ferrite are isolated, and the segregation coefficient of Cu at the interfaces between the internal conductors and the surrounding ferrite is 5% or less.

2. The multilayer coil component according to claim 1, wherein a pore area fraction of ferrite contained in side gap portions of a ferrite is within the range of 6% to 20%, the side gap portions being areas between side portions of the internal conductors and side surfaces of the ferrite.

3. The multilayer coil component of according to claim 1, wherein the segregation coefficient of Cu at the interfaces between the internal conductors and the surrounding ferrite is 3% or less.

* * * * *